United States Patent [19]

Labbe et al.

[11] 3,995,519

[45] Dec. 7, 1976

[54] ROD-MAKING MACHINES

[75] Inventors: Francis A. M. Labbe, Neuilly-sur-Seine, France; Edward George Preston, London, England; Paul Dingli, London, England; Ivan Yehudi Hirsh, London, England

[73] Assignee: Molins Limited, London, England

[22] Filed: Sept. 3, 1974

[21] Appl. No.: 502,468

Related U.S. Application Data

[60] Division of Ser. No. 378,451, July 12, 1974, Pat. No. 4,317,437, which is a continuation of Ser. No. 190,496, Oct. 19, 1971, abandoned.

[30] Foreign Application Priority Data

Oct. 20, 1970 United Kingdom ..... 49844/70

[52] U.S. Cl. ..... 83/310; 83/328; 83/926 C

[51] Int. Cl.[2] ..... A24C 5/28

[58] Field of Search ..... 83/310, 327, 328, 926 C

[56] References Cited

UNITED STATES PATENTS

| | | | |
|---|---|---|---|
| 3,479,913 | 11/1969 | Goemann et al. | 83/310 |
| 3,481,237 | 12/1969 | Hyde | 83/328 |
| 3,650,169 | 3/1972 | Gianese | 83/310 |
| 3,668,962 | 6/1972 | Chapmann | 83/310 |

FOREIGN PATENTS OR APPLICATIONS

| | | | |
|---|---|---|---|
| 1,270,478 | 6/1968 | Germany | 83/328 |

*Primary Examiner*—Frank T. Yost
*Attorney, Agent, or Firm*—John C. Smith, Jr.

[57] ABSTRACT

A ledger for a rod-making machine, especially a cigarette or filter making machine, comprises two rotary members arranged to rotate at the same speed about parallel axes and a connecting member which is pivotally connected to both of the rotary members and carries a rod support which supports the rod during each cutting stroke.

6 Claims, 4 Drawing Figures

ROD-MAKING MACHINES

This is a division of application Ser. No. 378,451 filed July 12, 1974, now U.S. Pat. No. 4,317,437, which in turn is a continuation of application Ser. No. 190,496 filed Oct. 19, 1971, now abandoned.

This invention is concerned with rod-making machines, especially machines for making cigarettes and cigarette filter rods, in which a continuous rod is cut into short rod sections while moving axially.

While the continuous rod is being cut, it is commonly supported by a reciprocating ledger. The present invention is concerned with a new form of ledger.

A ledger according to the present invention comprises two rotary members arranged to rotate at the same speed about parallel axes and a connecting member which is pivotally connected to both of the rotary members and carries a rod support which supports the rod during each cutting stroke.

Examples of ledgers according to this invention will now be described with reference to the accompanying diagrammatic drawings. In these drawings.

For convenience, in the description and claims, the ledger is described in terms of the rotary members having horizontal axes of rotation, but it should be understood that the axes of rotation could both be inclined to the horizontal.

Figure 1:
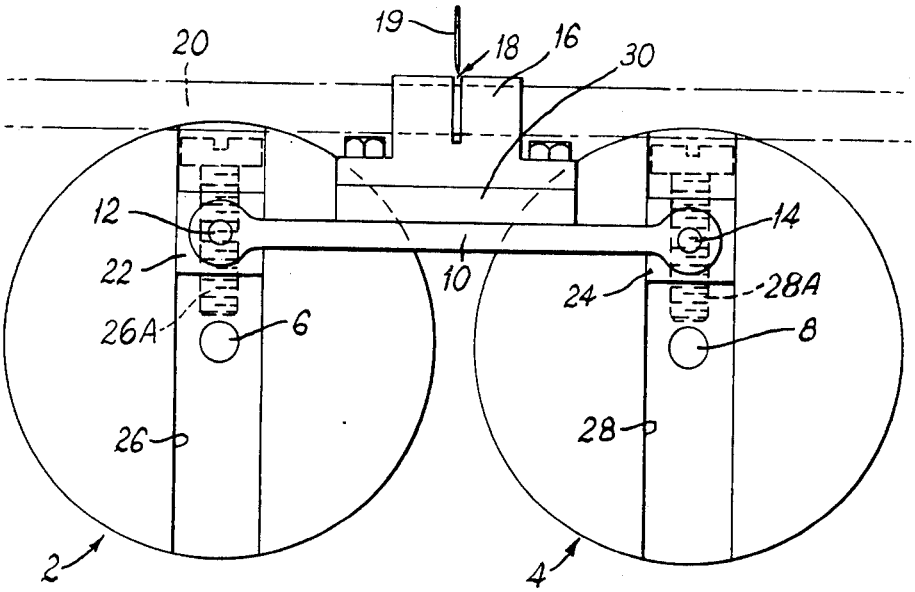
FIG. 1 is a side view of one ledger.
Figure 2:
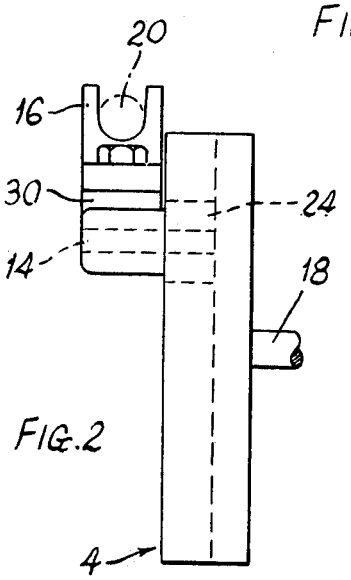
FIG. 2 is an end view of the ledger.

The ledger shown diagrammatically in FIGS. 1 and 2 includes two wheels 2 and 4 which are driven by parallel horizontal shafts 6 and 8 at the same speed. A connecting member 10 is pivoted at opposite ends to the wheels 2 and 4 by pivot pins 12 and 14 and carries above it a rod-supporting U-sectioned part 16 which has a transverse slot 18 through which a knife 19 passes to cut the rod 20 while the rod support 16 is supporting the rod. It will be understood that the rod support 16 moves along a circular path while maintaining its orientation with respect to the rod 20. Along the top of its path of movement it supports the rod during cutting.

The pivot pins 12 and 14 are fixed to slidable blocks 22 and 24 which are located in grooves 26 and 28 formed in the wheels 2 and 4. Thus the distance of each pivot pin from the axis of the wheel can be adjusted. This adjustment may for example be achieved by mounting on each wheel a captive screw 26A, 28A, which extends radially along the groove and passes through a correspondingly threaded bore in the associated block 22 or 24. Thus rotation of each screw moves the associated block along the groove. During use each pivot pin is set at the same distance from the shaft 6 or 8. Thus the length of the rod sections cut from the continuous rod can be adjusted, since the rod section length depends upon the crank radius (i.e. the distance of the pivot pins from the axis of rotation), being equal to $2\pi$ times the pivot pin radius. The rod section length may, for example, be adjustable over a range of 45 mm to 150 mm.

In order to arrange that the top position of the rod support 16 is always immediately below the cigarette or filter rod 20, the shafts 6 and 8 may be carried by a member which is vertically adjustable. Preferably, however, adjustment is achieved by using a variable amount of packing 30 between the rod support 16 and the member 10. FIG. 1 shows a relatively thick packing piece 30. A thinner packing piece is used if the crank radius of the pivot pins is increased to increase the rod section length. Alternatively, if shorter rod sections are needed, the blocks 22 and 24 can be screwed radially further towards the shafts 6 and 8, and a thicker packing piece can be used in place of the packing piece 30 to return the top position of the rod support 16 to the desired level.

The knife 19 may be in the form of a part of a helix on a rotary member which is inclined to the rod 20 so that the knife always lies at right angles to the rod 20 while it is cutting.

Figure 3:
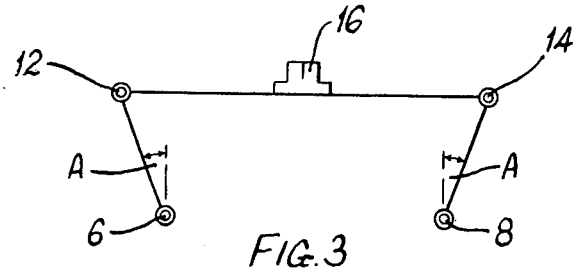
FIG. 3 is a line drawing showing the relevant lines of a modified form of ledger.

As the rod support 16 moves along a circular path, it moves vertically to a slight extent while each cut is being made. This is particularly so when the rod section length is small. To compensate to some extent for this rise and fall of the rod support 16, the two wheels 2 and 4 may be set slightly out of phase with one another, as shown in FIG. 3. FIG. 3 shows schematically the positions of the shafts 6 and 8 and pivot pins 12 and 14. It will be seen that the radial lines between the shafts and the pins are not parallel but are inclined away from one another when the rod support 16 is at its top position. Each radius arm is at this stage inclined to the vertical by the angle A. With this arrangement, as one end of the connecting member 10 drops (i.e. the left-hand end if the direction of rotation is anti-clockwise), the other end of the member 10 rises slightly. This compensates slightly for the dropping of the left-hand end. The angle A is shown large for the purpose of illustration, and may in practice be somewhat smaller. The angles of inclination of the two radial lines need not in fact be the same (i.e. when the rod support 16 is at its top position), and as a further alternative the inclination of the radial lines may be in the opposite sense, that is to say towards one another.

With this arrangement shown in FIG. 3, it is necessary to allow for a slight freedom of sliding motion of the connecting member 10 with respect to one of the pivot pins 12 or 14 in the direction of the connecting member 10. This is because the distance between the pivot pins 12 and 14 varies slightly during each revolution of the wheels 2 and 4. It should further be noted that the rod support 16 in this case performs a slight rolling motion relative to the rod 20; for this reason the surface of the rod support 16 which engages below the rod 20 may be slightly convex in a longitudinal section through the bottom of the U section.

Figure 4:
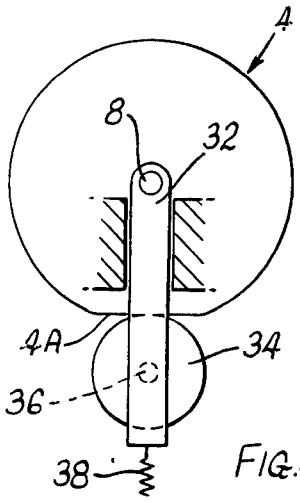
FIG. 4 shows a different possible modification.

FIG. 4 shows a different possible way of compensating for the slight vertical movement of the rod support 16 with respect to the rod during cutting. It is a view from behind the wheel 4, which in this case is carried by a vertically slidable part 32. The wheel 4 rests on a wheel 34 mounted on a stationary spindle 36, and the part 32 is pulled down by a spring 38 so as to hold the wheel 4 in contact wih the wheel 34. The peripheral surface of the wheel 4 is formed as a cam which controls the vertical position of the wheel 4 in a manner such that the vertical movement of the center of the rod support 16 with respect to the rod 20 during cutting is reduced or substantially eliminated. FIG. 4 shows the periphery of the wheel 4 formed with a flattened portion 4A which is shown somewhat exaggerated in FIG. 4 for the sake of clarity. This flattened portion lies at the bottom of the wheel 4 when the rod support 16 is at its top position. The amount of compensation for the vertical movement of the rod support 16 during cutting depends upon the radius of the pins 12 and 14. However, the cam shape of the wheel 4 may be such as to provide approximately the mean compensation required for the full range of rod lengths. As an alternative, the cam may be formed on a separate member attached to the wheel 4, and this cam member may be replaceable so that a different cam can be used for different rod lengths. As a further alternative, the wheel 4 may have slightly different cam profiles in different planes normal to the shaft 8, and the wheel 34 may be adjustable as to the axial position so that it can engage the wheel 4 in any of the various positions in which different cam profiles determine degrees of up and down movement of the wheel 4. For example, the flattened portion 4A may be formed in two or more steps (i.e. as viewed in a plane passing through the axes of the shaft 8 and spindle 36). Each of the discrete cam profiles can be used for a given range of rod lengths. The axial position of the wheel 36 can be made adjustable by means of a screw. A further possible alternative is possible to form a continuously varying cam profile portion 4A since the force between the wheel 4 and wheel 34 is small. Yet another possibility is that the wheel 4 may have a circular outline, and the wheel 34 may be formed as a cam, in which case the wheel 34 would be driven at a speed such that its peripheral velocity equals that of the wheel 4.

In all the above examples where the wheel 4 is arranged to move up and down during each revolution, the shaft 8 may simply provide a rotational mounting for the wheel 4, and the drive may come from the wheel 2 via the connecting member 10.

As an alternative to the wheel 4 being mounted on the vertically movable member 32, it may be mounted at the end of the horizontal lever pivoted about a horizontal axis. In the case, the vertical height of the wheel 4 may be controlled by means of a driven cam engaging a wheel on the lever.

In the arrangements so far described, the wheels 2 and 4 perform one revolution for each cut. As an alternative, two similar such devices may be placed side by side with their rod supports 180° out of phase with one another so that the speed of rotation can be halved. For this purpose the two devices may be mirror images of one another about a central vertical plane lying along the axis of the rod, each support 16 being arranged to project away from its associated wheels (and towards the other device) so that the rod supports can both move along circular paths (180° out of phase with one another) without clashing with the connecting members 10.

We claim:

1. A ledger for a rod-making machine for supporting a continuous rod at periodic intervals while being cut during each stroke of a cutting device, comprising two rotary members arranged to rotate at the same speed about parallel axes, each of said rotary members including pivot means spaced radially a predetermined distance from the axis of said rotary member, a connecting member extending between said pivot means of said rotary members pivotally connecting said connecting member to both of the rotary members, a rod support on said connecting member for supporting the rod during each cutting stroke, and a cam device for raising and lowering at least one of the rotary members during each revolution to reduce the vertical movement of the rod-supporting member while it is supporting a rod during cutting.

2. A ledger for a rod-making machine for supporting a continuous rod at periodic intervals while being cut during each stroke of a cutting device comprising:

a pair of rotary members arranged to rotate at the same speed about parallel axes, each of said rotary members including pivot means spaced radially a predetermined distance from the axis of said rotary member, b. a connecting member extending between said pivot means of said rotary members pivotally connecting said connecting member to both of said rotary members for movement about a closed path, said connecting member including means to support said rod during each cutting stroke as said support means moves through a part of said closed path, and c. means for raising and lowering at least one of said rotary members to cause said support means to move along a substantially flat plane through said part of said closed path, d. whereby said closed path is substantially circular except for said part which is substantially flat and displacement of said rod by said support means is thereby prevented.

3. A ledger according to claim 2 wherein said raising and lowering means comprises cam means.

4. A ledger according to claim 3 wherein at least one of said rotary members includes a circular periphery with a flattened cam portion and said ledger further comprises a stationary cam follower.

5. A ledger for use in a rod-making machine, for supporting the rod during cutting, comprising a first rotary member mounted for rotation about a first axis, said first rotary member including first pivot means spaced radially a predetermined distance from said first axis; a rod-supporting member mounted on said first pivot means on the first rotary member for rotary movement about a closed path, said path being located such that said rod-supporting member engages and supports the rod while passing through a portion of said path; a second rotary member mounted for rotation about a second axis parallel to but spaced from the first axis of the first rotary member and including second pivot means spaced radially a predetermined distance from said second axis, the rod-supporting member also being mounted on said second pivot means on the second rotary member to maintain the rod-supporting member at a substantially constant orientation while the rod-supporting member moves about said closed path; and cam means for superimposing upon the rotary movement of the rod-supporting member a rising and falling motion at said portion of said path, said cam means comprising means on said first rotary member providing a mainly circular periphery with a central axis coincident with said axis of rotation of said first rotary member, said periphery including also a flattened portion, and stationary means engaging said periphery whereby a rising and falling motion is imparted to said first rotary member and consequently is superimposed upon said rotary movement of said rod-supporting member and the portion of said path through which said rod-supporting member passes while supporting the rod during cutting is substantially rectilinear.

6. A ledger according to claim 5 in which the said means for engaging the periphery comprises a rotary member arranged to roll in contact with the periphery.

* * * * *